US009033142B2

(12) United States Patent
Newman

(10) Patent No.: US 9,033,142 B2
(45) Date of Patent: May 19, 2015

(54) ERGONOMIC GARMENT CARRIER

(76) Inventor: Catherine Claire Newman, Oakland, CA (US)

( * ) Notice: Subject to any disclaimer, the term of this patent is extended or adjusted under 35 U.S.C. 154(b) by 100 days.

(21) Appl. No.: 13/532,796

(22) Filed: Jun. 26, 2012

(65) Prior Publication Data

US 2013/0341220 A1 Dec. 26, 2013

(51) Int. Cl.
*A45C 3/02* (2006.01)
*A45C 3/00* (2006.01)

(52) U.S. Cl.
CPC ..... *A45C 3/004* (2013.01)

(58) Field of Classification Search
CPC ..... A45C 3/004
USPC ..... 206/278, 287, 1, 292; 190/112
See application file for complete search history.

(56) References Cited

U.S. PATENT DOCUMENTS

| | | | | | |
|---|---|---|---|---|---|
| 2,086,895 | A | * | 7/1937 | Cart | 190/127 |
| 2,154,630 | A | * | 4/1939 | Marbury et al. | 190/111 |
| 2,261,291 | A | * | 11/1941 | Salavsky | 190/113 |
| 2,596,412 | A | * | 5/1952 | Kish, Jr et al. | 206/292 |
| 3,115,959 | A | | 12/1963 | Jaffe | |
| 3,811,543 | A | | 5/1974 | Parrochia | |
| 3,958,675 | A | | 5/1976 | Rosenblum | |
| 4,655,343 | A | | 4/1987 | Lane et al. | |
| 4,693,368 | A | * | 9/1987 | King et al. | 206/287.1 |
| 4,736,839 | A | | 4/1988 | King | |
| 4,817,791 | A | * | 4/1989 | Adams | 206/287.1 |
| 4,927,014 | A | | 5/1990 | Pulichino | |
| 5,060,795 | A | | 10/1991 | Bomes et al. | |
| 5,259,539 | A | | 11/1993 | Brotman | |
| 5,469,967 | A | | 11/1995 | Boorady | |
| 5,505,297 | A | | 4/1996 | Myers | |
| 5,566,797 | A | | 10/1996 | Van | |
| 5,624,026 | A | | 4/1997 | Chernoff | |
| 5,819,890 | A | | 10/1998 | Lin | |
| 5,871,133 | A | | 2/1999 | Robinson | |
| 5,884,737 | A | | 3/1999 | Cabo | |
| 6,076,666 | A | | 6/2000 | Santa | |
| 6,830,148 | B2 | | 12/2004 | Glaser et al. | |
| 2007/0261975 | A1 | | 11/2007 | Rabinoff | |

FOREIGN PATENT DOCUMENTS

| | | | |
|---|---|---|---|
| RU | 46907 | U1 | 8/2005 |
| RU | 69041 | U1 | 12/2007 |
| RU | 2393980 | C2 | 7/2010 |
| RU | 2440014 | C1 | 1/2012 |

OTHER PUBLICATIONS

International Preliminary Report on Patentability issued Dec. 31, 2014 from corresponding International Patent Application No. PCT/US2013/047447, 5 pages.

International Search Report mailed Sep. 19, 2013 from corresponding International Patent Application No. PCT/US2013/047447, 2 pages.

* cited by examiner

*Primary Examiner* — Sue A Weaver
(74) *Attorney, Agent, or Firm* — Fish & Richardson P.C

(57) ABSTRACT

An ergonomic garment carrier which accommodates garments such as suit shirts, jackets, pants and skirts as well as other items a traveler would typically transport or store.

15 Claims, 6 Drawing Sheets

ERGONOMIC GARMENT CARRIER

CROSS-REFERENCE TO RELATED APPLICATIONS

Not applicable

FEDERALLY SPONSORED RESEARCH

Not applicable

SEQUENCE LISTING OR PROGRAM

Not applicable

BACKGROUND OF THE INVENTION

Field of Invention

This invention relates to the ergonomic design of luggage that accommodates garments such as suit-shirts, jackets and pants, as well as other personal items typically transported during travel.

Business travelers, as well as many other types of travelers, wish to maintain the presentability of their garments using simple, ergonomic luggage, which will maintain the appearance of their clothing and minimize the wrinkling that occurs during transport.

However, in recent years, the state of travel has changed appreciably, complicating the travel process for users. Many of these new travel challenges have arisen from the increased and more involved security procedures. These revised security procedures have placed more stringent restrictions and limitations on the size, weight and contents of travelers' luggage and have required travelers to intermittently present their luggage contents to security personnel. With these added complications, travelers, now more than ever, desire simple, ergonomic luggage, which, wherever possible will ease the strains of travel. Common forms of luggage for transporting clothing and other personal items are suitcases, garment bags, backpacks and the like. While many forms of luggage are known, new inventions must address today's modern set of travel needs, and must equally consider the ergonomic and practical utility for the ever-broadening range of travelers.

A high-priority need of business travelers in particular is the ability to maintain the presentability of their garments over the course of the traveling process. While, this need is not exclusive to business travelers it is in all regards unmet in today's market.

The greatest challenge when it comes to maintaining the presentability of garments is the prevention of wrinkles and creases during transit. Wrinkles and creases are caused when a fold is made in a garment and localized pressure is applied. The prevention of wrinkling and creasing a top priority for many travelers. Most often the prevention of wrinkles and creases is achieved through a collection of techniques known as 'flat-packing'. 'Flat-packing', as the name implies, can be roughly described as the arrangement of clothing primarily along its coronal plane, where what is commonly known as the 'front' and 'back' surfaces of garments are mated together. Garments in this configuration are layered upon one another and stored flatly as a group during transport. This sandwiching of garments provides distributed support to each of the garments while in transit, and prevents individual garments from being wrinkled or creased.

'Flat-packing' is most successful in the prevention of wrinkles and creases when the interface between garments and the luggage containing them is relatively flat and even, and the area between the garments and the luggage is minimized. This allows for consistent pressure to be distributed lightly across the whole of garment surfaces and for the garments to approximately retain their designated configuration while in transit. This is to say that garments typically weather transport best when uniform pressure is applied and the garments are snuggly sandwiched during travel.

In everyday life, however, it is not easy to carry flat pack clothing successfully. It is when garments can shift, are improperly secured, or are up against uneven elements, that they become wrinkled or creased. These wrinkle-causing elements are often aspects of the luggage design itself and are not within the control of the traveler.

When considering luggage designed to maintain garment appearance, the related art primarily addresses the need to transport garments of the business suit variety (4736839). When compared to today's array of acceptable business attire, business suits are not the contemporary choice for most business travelers. Today, acceptable business attire for women and men often may simply include a pressed shirt and a nice pair of pants or skirt, rather than a business suit. These and other similar garments are typically less bulky than business suits. Nevertheless, the professional appearance of these types of attire must be preserved. Unfortunately, the lightweight nature of the average pressed shirt or skirt makes these garments more prone to wrinkling and creasing when in transit.

Studies have shown that an increasing proportion of women are traveling for business, which indicates a need for luggage which is ergonomically acceptable for women and which can successfully transport female professional attire. Studies have also indicated that now more than ever before travelers are opting to take shorter trips, more frequently in both the business and leisure categories. These facts further illustrate that luggage designed to transport a business suit, or business suits, are not addressing the needs of many modern business travelers, many of whom may be traveling with few garments but who nevertheless wish to maintain each garment's appearance.

On the whole, the related art does not combine the ability to pack, carry and transport theses types of garments with ease and without wrinkling or creasing the garments.

In some cases, unnecessary wrinkling and creasing is caused when a user's garments are, on average, much smaller in proportion to the luggage storage area, and therefore require less space than a traditional business suit. The packed garments then 'swim' inside of the luggage during travel and after transport, this 'swimming' has caused wrinkles and has degraded the appearance (3811543, 5060795, 5469967, 6076666).

In other scenarios, it is the case that the user's garments are on average larger in proportion to the available packing area. In this case the garments must be folded in order to fit. This creates creases and wrinkles in the garments (5624026).

In a related aspect, historical attempts to design luggage for universal use (designed to be large enough, long enough, and wide enough to fit every possible size of garment), the value and universality of this type of luggage is limited and the result is that some user's garments are too large, while others too small. Other related art has included extensions and other design aspects to achieve broadened usage but which instead complicate the packing process (5060795). Given today's modern travel demographics, the result is often luggage that is bulky and burdensome on the user and in the end causes wrinkles and creases in the garments.

Another cause of wrinkles and creases is when garments are inadequately or improperly secured because a necessary mechanism is not provided to prevent the garments from reconfiguring in transit (3115959, 3811543). This presents at least two problems. First, clothing smaller or thinner than a suit, which is more difficult to secure satisfactorily, does not stay in place and the appearance is not maintained. Secondly, if not properly held in place, garments of any type will shift and become wrinkled. Additionally, some inventions have attempted to provide unique securing mechanisms for garments which in effect complicate the packing process (4736839, 5566797, 5819890) and in other cases the effectiveness of the invention relies on a user-supplied apparatus, such as a hanger (3811543, 6076666).

Another aspect of design found in the related art that causes wrinkling and creasing are the sharp folds in the flexible portions of the invention itself. These folds are traditionally designed to make the luggage smaller overall. These folds, however, also fold the incorporated garments at a sharp angle, creating creases in the garments during travel (5469967, 6830148).

There is also related art which provides multiple means for carrying the luggage during transit. Examples of these carrying means include straps, handles, yokes and the like. In some cases, these multiple carrying modes also change the orientation of the apparatus when switching from one mode to another, resulting in an undesired redistribution of the contents, which then results in wrinkling (4655343, 5819890, 5884737).

There are also additional factors which play a role in the design of a successful piece of luggage, many of which related to the difficulties facing modern-day travelers. The unique needs of today's modern day traveler include but are not limited to the following:

First, it is now the common practice that the quantity of luggage per traveler is restricted; therefore individual pieces of luggage must serve many purposes and hold a variety of travel items, especially luggage which will be 'carried-on' with the traveler. Also, with travelers taking shorter, more frequent trips, 'all-purpose' luggage holds significant value.

It is a particular disadvantage of the garment-bag style related art that it is not 'carry-all' in nature, meaning that either the luggage cannot transport items in addition to 'flat-packed' garments or in an equally unfortunate scenario, if garments are not packed in the 'flat-pack' style, this type of luggage cannot be used more generically so that garments and other items can be transported using an alternative packing scenario. In both cases another piece of luggage must be used by the traveler. This reduces the value and usefulness of such related art (5259539, 6076666, 6830148).

Second, the personal security of the traveler's belongings is a significant concern during travel as well as being a regulated responsibility by governmental authorities. In many airports and train or bus stations, "please keep luggage with you at all times", is a frequently heard announcement and is prominently displayed on official signage. This requires that luggage be both tracked and tended to by the owner throughout the travel process. Intermittent access to luggage contents by the traveler is often necessary during security screenings and at other times during the travel process. In light of the heightened security restrictions, it is another disadvantage that related art examples do not allow for intermittent access to their personal contents during transit in a fashion that is secure and private. For one, traditional garment bags fold downward and do not provide intermittent access to the items (4736839, 5060795) and other forms of garment-style travel bags also do not provide intermittent access to the user's possessions (4655343, 5624026, 6830148, 6076666). For another, those which do provide access, many do not provide privacy (3115959). Additionally, other types of travel bags that provide intermittent access also cause a reconfiguration of garments in a manner that causes them to wrinkle or which requires the user to rummage through the luggage contents.

Third, on the whole, the travel process has become more involved, and is in general a difficult process to manage for most individuals. Today, this process often includes, "check-in", document-control and multiple security screenings. It is also common that at multiple points during this process, various possessions must be removed and presented for inspection. These steps in conjunction with the entire travel process can be physically taxing and difficult on the body.

Effective use of established ergonomic design principles can minimize the impact of such repeated loading and carrying of luggage on the human body. Ergonomic consideration of a traveler must also consider that her or his physical needs may change over the course of the product's lifetime. For example one's physical needs and capabilities may change as a result of age, pregnancy, or injury.

It is also important to consider that an increasing proportion of business travelers are women, significantly greater than in previous periods. The ergonomic needs of adult female bodies are distinctly different than adult males and this must be taken into consideration. Furthermore, travel luggage today, more often needs to accommodate unique categories of travel items and attire used more frequently by women than men.

Ergonomic user-considerations are very important when the traveler is in transit. There are factors that inform the ergonomic design of any object utilized by humans. A general ergonomic principle when carrying any load is to, "Hold the load as close to the body as possible in order to limit both mechanical stress and energy consumption." (Dul & Weerdmeester, 2008). Some additional ergonomic tenets relevant to this invention include the consideration of; the overall weight, the distance from the body's joints, the carrying orientation and the self-supporting nature of the travel pouch, each of which must be taken into account.

From an ergonomic perspective it is preferable to provide a supportive, reduced weight piece of travel luggage which can accommodate a variety of garment sizes while preventing wrinkling because bulky luggage is cumbersome during travel and is generally difficult on the body.

In the related art, the absence of beneficial ergonomic principles are manifest in a variety of ways.

For one, ergonomic principles are not often employed to allow travelers to carry travel luggage in healthy ways. This is first evident in that many design do not allow for the invention to be carried using straps which go over the shoulder or across the back (5624026). In addition there are also inventions that provide such carrying means, but which are non-ergonomic (3115959, 3811543, 3958675, 5884737) and potentially harmful to the user.

Furthermore, many inventions do not provide multiple means for carrying (5259539, 6830148). This is important as users should be provided with multiple carrying options so that the weight may be redistributed by the user as needed throughout the travel process. This is also important as the user may need alternative carrying means at different points of the product's lifetime.

There are additional aspects of an invention which do not allow the user to transport luggage in healthy ways, for example, related art, with the 'fold-down' embodiment brings the weight out further than necessary from the shoulder (47736839, 5505297), which puts unnecessary stress on the user's joints.

"Small compact loads are preferable to larger loads" (Dul & Weerdmeester, 2008). Luggage which is over-sized, and unnecessarily large, perhaps designed to accommodate a wide set of users, puts unnecessary stress on the user's joints (5884737). Bulky, unstructured luggage also takes it toll on the body by not being to some degree self-supporting, causing eccentric loading on the body's joints and adding unnecessary torque.

Another ergonomic-related issue is the presence of rigid members such as bars, beams, and the like, which are designed to provide structural support to the invention, but which exert concentrated stress on the human body when transported or carried (3958675, 5871133), potentially causing harm or injury to the user.

It is also important to consider the ergonomics at times other than when the traveler is in transit. An example is the space required to pack and unpack the invention with belongings. In hotels and at home there is often not a lot of table space to extend luggage widely for packing and a review of related art reveals inventions which have not made design considerations for this need (4927014, 5566797, 5819890). This may be both an inconvenience for the traveler but also may instigate cumbersome body positioning from the user.

Finally, storage space in homes is for many users often limited and when not in use, many styles of luggage take up more space than necessary (5505297, 5884737). Many styles of luggage which are rigid in nature, do not allow for compact storage when not in use (4736839, 5505297).

In conclusion, an examination of related art and market need does not reveal an invention which addresses both the current set of traveling restrictions and provides suitable solutions for the increasingly diverse set of travelers. This examination has indicated a need for ergonomic luggage used to transport business or formal attire and which is suitable for a broad range of business and casual travelers. It is not impossible to address all of these many design challenges in a comprehensive and satisfactory way. Unfortunately, simple and satisfactory solutions are not present in the prior art.

Objects and Advantages

The invention, roughly described, comprises a simple, self-supported, compact envelope, designed to contain garments and to be carried ergonomically by a user. This invention uniquely tackles the combination of challenges brought about by the complexities of modern travel.

Several of the specific challenges being addressed, with others becoming apparent from the appreciation of the specification and claims on the whole are:

(a) the ability to pack and transport business attire and other garments with minimal wrinkling and creasing using a simple sandwiching technique;

(b) a piece of luggage ergonomically designed for the general body health of a wide range of human bodies and the other physical needs of travelers;

(c) the easing of the steps in the travel process such as, packing, transport, access during security screenings, storage during transport, unpacking and storage when not in use;

(d) while also meeting governmental travel restrictions and 'carry-on' requirements.

It is the primary object of the present invention to provide an ergonomic travel pouch which addresses, by design, many of the disadvantages found in conventional garment-bag-style luggage.

It is another primary object of the present invention, to provide adequate means for reduced or wrinkle-free transport for garments. The present invention reduces wrinkles and creases in at least the following ways:

(a) The invention uniquely provides a shell of flexible or semi-rigid material, inside of which garments may be 'flat-packed' and encased. For the duration of the travel process (after packing until being unpacked), the invention uniquely places uniform pressure on the packed garments via its envelope-like shape.

(b) The invention does not require rigid elements with hard edges which are often the cause of wrinkling and creasing.

It is another object of the present invention to provide supports within the inner portion of the garment pouch which may be used to secure garments as well as to accommodate garments of all lengths, again with reduced wrinkling during transport. This aspect also provides the additional advantage of securing the garments without adding significant effort or complication for the user during the packing process.

The ergonomic garment carrier can uniquely organize garments of varying sizes, so that they may be packed without large gaps existing between the garments and the luggage. This prevents the garments from radically changing position in transit and becoming wrinkled or creased. This also provides the market advantage of an invention which can be used by people of variety of sizes without compromising the ergonomic utility and in general improves the versatility of the invention by accommodating varying lengths of garments.

The novel packing method improves on the established 'flat-packing' technique, with the addition of the 'sandwiching'-pressure (relatively uniform, flat, and distributed) supplied by nature of the pouch itself along with the ability to 'turn-over' the garments using the supplied securing bands rather than folding them. This produces a rounded radius in the garments rather than the traditional fold—which when pressure is applied will cause wrinkles or creases. This novel method has a number of advantages including: achieving universality (of use for most body sizes), and the accommodation of a wide variety of garment lengths. This aspect of the carrier does not add overall length to the invention and further reduces the bulk of the invention which is of benefit for ergonomic purposes and reduces material use. Finally, the slim nature of the device further allows for a minimal gap between the garments and the carrier, again for the prevention of wrinkling and creasing during transit.

It is another object of the present invention that it may contain novel hanger-type apparatus, which is sturdy but light in weight. This apparatus may be permanently secured or removable, but when installed does not impede the use of the carrier or packing of garments, even if unused by the traveler.

It is another advantage of the present invention that in the closed position, the invention takes on a ergonomic shape which does not fold garments sharply (or in different terms, at a very acute angle) but instead provides wide radius curves to prevent sharp folds and the resulting creases. This also has the advantage of reducing the length to weight ratio of the invention when being carried by the user.

Yet another advantage of the present invention is that it also provides multiple ergonomic carrying means for use at the discretion of the user. These carrying means, which may be straps, handles, backpack straps and the like, will not subject the contained garments to the stress that causes wrinkles and creases either by placing new or irregular pressure on the garments as a result of the invention is being held up against the body or the orientation of the carrier has changed. The presence of multiple carrying handles and straps allows not only for each user to transport the garment pouch in a way best for her or his body, it also allows for each user to alternate the carrying methods, for example from handles to straps or from shoulder straps to backpack-style straps, etc—this is ergonomically preferred for all human bodies when carrying loads for any extended period of time.

It is another advantage of the present invention that the provided carrying means may be adjustable to provide further versatility to the user.

Further it is an advantage of the present invention that traveler's contents are accessible during transport while in the closed travel configuration, as is often necessary in cases such as security screenings and document verifications. Additionally, intermittent access during transit is achieved without reconfiguration of the garments in a manner that causes the garments to wrinkle or which is requires the user to sift through or shift travel items for access.

An additional advantage of the present invention is that in providing intermittent access to the user's personal contents during the travel process, the user is still afforded privacy of her or his personal effects and this is done without exposing or spilling the contents.

An additional advantage of the present invention it that it does not rely on rigid elements with hard edges to provide structure. It is often the presence of rigid elements that support and provide structure to the luggage that are ergonomically detrimental for the user.

It is another advantage of the present invention that aspects of the invention that can expand to accommodate more items, and yet remain compact when these expansion features are not being utilized. This is an additional ergonomic advantage in that it is preferable for the invention to remain compact and balanced when the user is transporting the invention.

It is another advantage of the present invention that the garment pouch is easily transformed into the closed travel configuration, which is in a compact form and of ergonomic advantage to the user.

It is also another advantage of the present invention that the entirety of the apparatus and its contents can be maintained compactly and close to the body of any user. This is desirable because this helps to maintain the human joints (shoulders, hips, spine, etc) close to their neutral position.

In a related fashion, it is an advantage of the present invention that it leverages the carrier's base of support to reduce the overall length of the invention when it is in its closed position. This reduces the torque places on the joints and the repeated eccentric loading exerted on the user while in transit.

It is another object of the present invention that it is self-supporting in nature, and can reside upright in the closed configuration without need of rigid members which can be painful on the body.

It is another advantage of the present invention that it can be utilized in the 'closed' position, and while it has the capability to store and transport garments in the flat-pack manner, it is also possible to transport garments in a folded configuration as well as other items without loss of space or utility.

There is yet another advantage of the closed configuration, that when in the closed position, the traveler may store additional travel items, whether they be garments or other items such as shoes, hairdryers, undergarments, and the like. This aspect brings value to invention as an 'all-purpose' travel bag.

It is another advantage of the invention that the closed configuration it is usable and ergonomic when garments are not 'flat-packed' in the main garment cavity. Travel items such as shoes, hairdryers, undergarments, and the like may still be stored successfully and the carrier used during travel. This attribute makes this invention valuable not only for travel but for daily use as an exercise bag or as a daily work or school bag.

Yet another object of the present invention is the minimized surface area required when the garment pouch is in it's fully extended position, this minimizes the space required when packing and unpacking garments. The present invention accomplishes this through the use of layering and overlaying, and finding more available space within the given volume instead of requiring additional surface area when the carrier is its extended position. The invention also accomplishes the need to use minimal surface area by defining an additional storage area when the carrier is in its closed position. This will become apparent in the drawings and description to come.

It is another object of the present invention that additional storage areas, such as pockets, are found in convenient regions for the user.

It is another object of the present invention that straps, pockets or other securing means may be provided for items such as shoes, hairdryers, swimsuits and the like.

It is another advantage of the present invention that when not in use, it can be stored compactly without damage to the function or appearance of the invention. This is a desirable attribute because storage space is often scare in many modern homes.

It is another advantage of the present invention that dimensions and location of features of the invention may be modified before manufacture based on user need while still maintaining the overall intent of the invention.

It is also another advantage of the present invention that there is space for additional convenience items, for example, a key ring.

Still further objects and advantages of my invention will become apparent from a consideration of the ensuing description and drawings.

SUMMARY

In accordance with the present invention, an ergonomic garment carrier which accommodates garments such as suit shirts, jackets, pants and skirts as well as other items a traveler would typically transport or store.

DRAWINGS

Figures

REFERENCE NUMERALS

Figure 1:
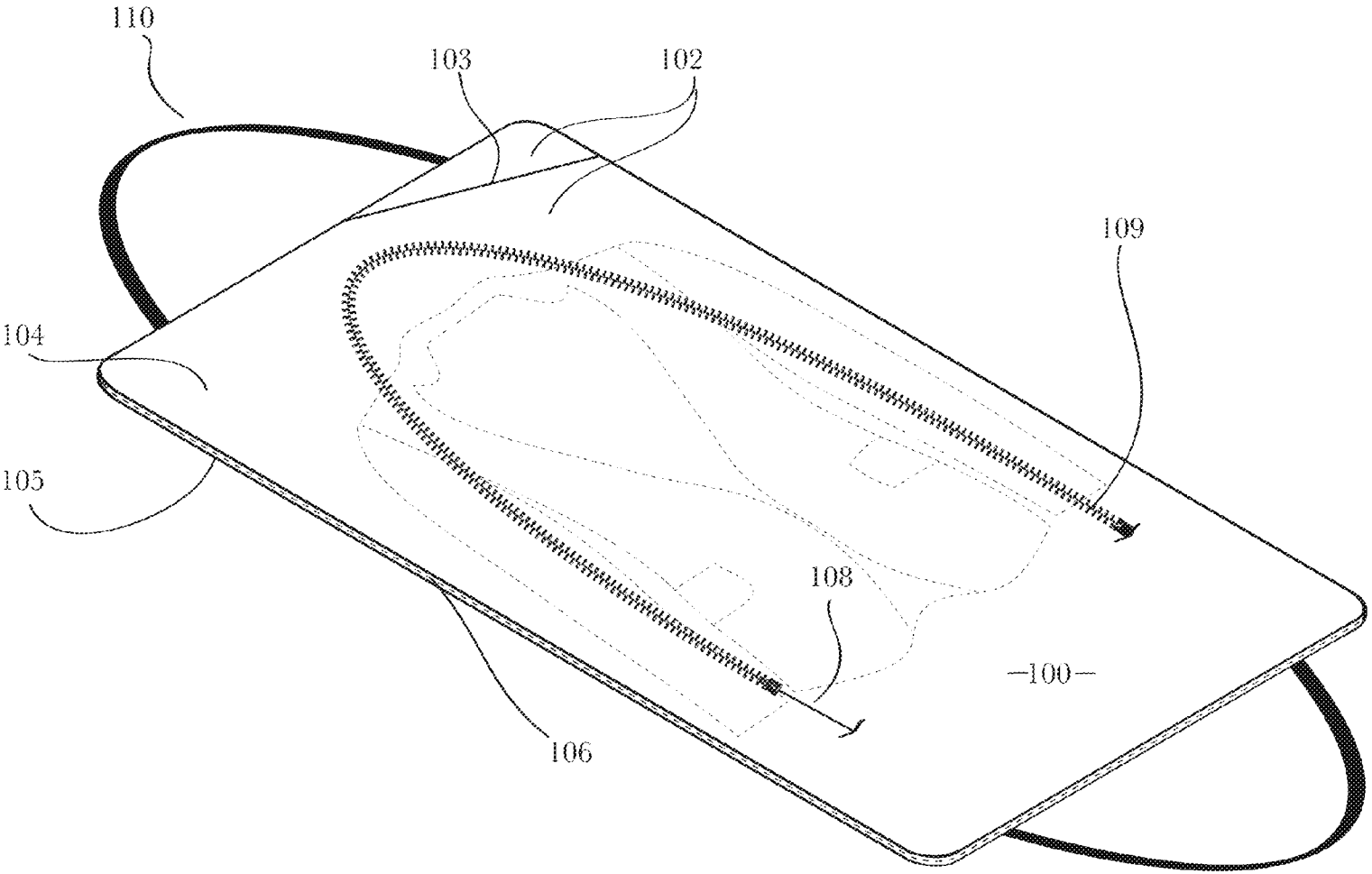
FIG. 1 is a perspective view of the essential elements of the garment carrier in the open configuration.

100 elongated pouch
102 flexible panels

103 common edges
104 first sheet
105 second sheet
106 common peripheral edges
107 main storage cavity
108 plackets
109 closure
110 carrying means
111 internal bands
112 hooking loop
113 securing apparatus
114 internal pockets
115 pocket openings
116 reversible closures
117 optional panels
118 secondary storage cavity
119 secondary carrying means
120 flexible sides
121 supplementary elastic straps or flexible pockets
122 base of support
123 external pockets
124 third carrying means
125 reversible closure
126 backpack-style straps
127 supplementary closing panels

DETAILED DESCRIPTION

FIG. 1 is a perspective view illustrating the basis of the present invention, from here on referred to as the elongated pouch (100). The elongated pouch is constructed through the assembly of a multiplicity of flexible panels (102) and is generally rectangular in shape. These flexible panels may be fabric or plastic or other flexible or semi-rigid material. In the preferred embodiment the flexible panels are sewn, bound or adhered together along their common edges (103) to create the two halves of the elongated pouch. These two halves, defined by the assembly of flexible panels (102), define the two sheets of the elongated pouch (100), from here on referred to as the first sheet (104) and the second sheet (105). The first and second sheets (104 & 105) are substantially bound together along their common peripheral edges (106) to form the elongated pouch (100), again, as illustrated in FIG. 1.

Figure 2:
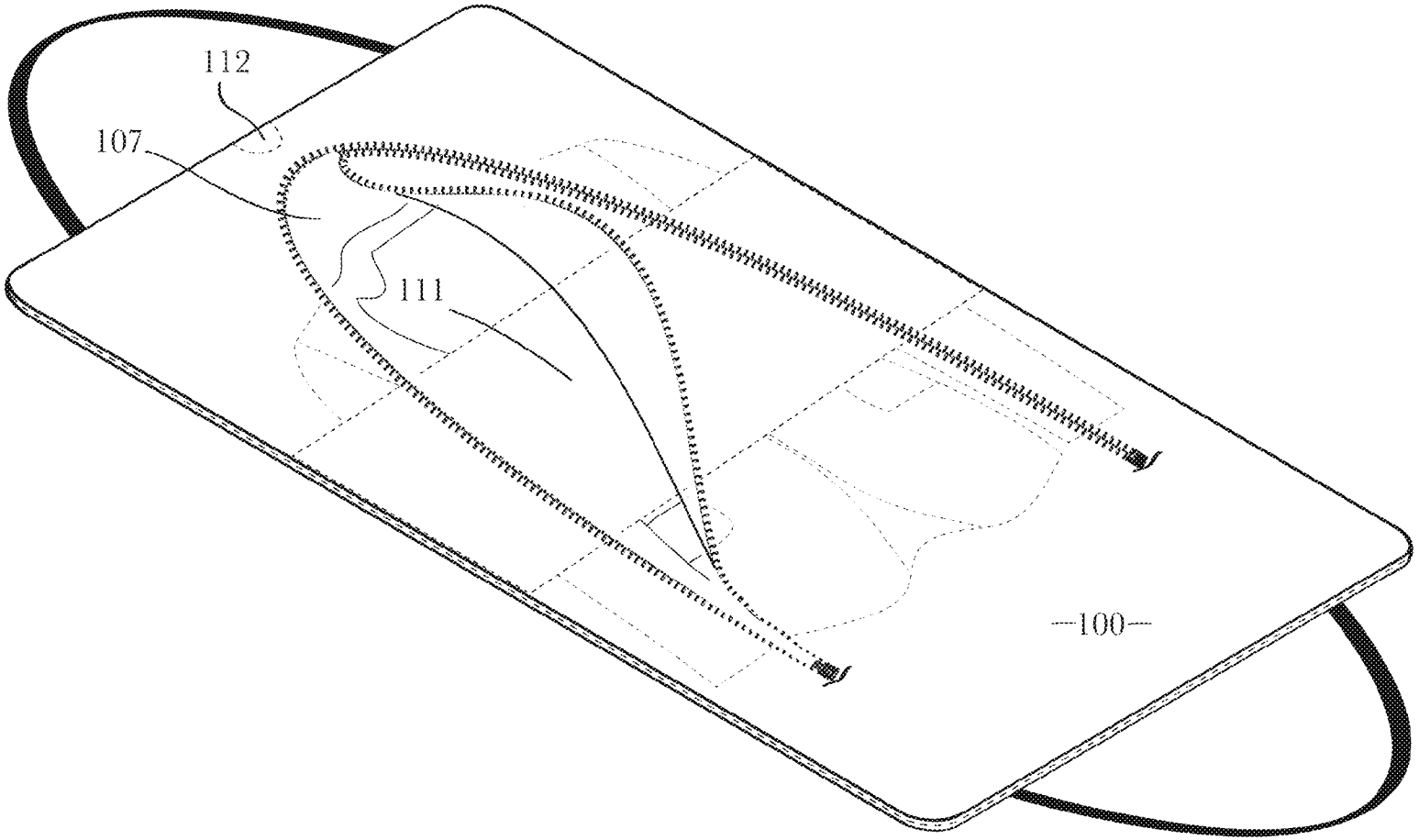
FIG. 2 is a perspective view of the internal securing features of garment carrier, again in the open configuration.

The area between these two connected sheets (104 & 105), which are now substantially connected along the common peripheral edges (106), is considered the main storage cavity (107)—see FIG. 2 for illustration. This cavity defines a volume for storage as well as the internal and external surfaces of the elongated pouch (100).

Access to the inside of the main storage cavity (107) of the elongated pouch (100) is created via plackets (108) or other style of openings or voids. These openings may be temporarily sealed using a variety of closure types for example zippers, velcro or the like, from here on referred to as a closure (109).

Additional plackets (108) may be found in multiple locations on the invention to provide convenience to the user during packing or to provide access to the inside cavity via any portion of the elongated pouch (100).

A multiplicity of straps, handles or other carrying means (110) are attached to the elongated pouch which allows the elongated pouch, with its contents, to fold, in on itself, into what is referred to as the closed position (see FIG. 5) and to be transported ergonomically by a user.

FIG. 2 is a perspective view of the elongated pouch (100) illustrating how the user can install and access items within the main storage cavity (107) via plackets (108) as well as some of the preferred internal securing features. The main storage cavity (107) can be bifurcated or divided in other ways using additional panels to define desired compartments.

Internal bands (111), straps or other style of securing apparatus are found in the main storage cavity (107) and are used to secure and tether travel items during transport. The internal bands are for optional use when the garments are stored within the main storage cavity (107). The internal bands (111) do not impede or interfere with the packing of garments and will not wrinkle or crease the garments, but may be of assistance at the users discretion.

In cases when garments are longer than the elongated pouch (100), garments maybe turned over by passing the garments under the internal bands (111) of the user's choosing and then laid over for the bands for storage and transport without creasing.

The hooking loop (112) represents a means to secure an additional hanging or securing apparatus supplied by the user.

Figure 3:
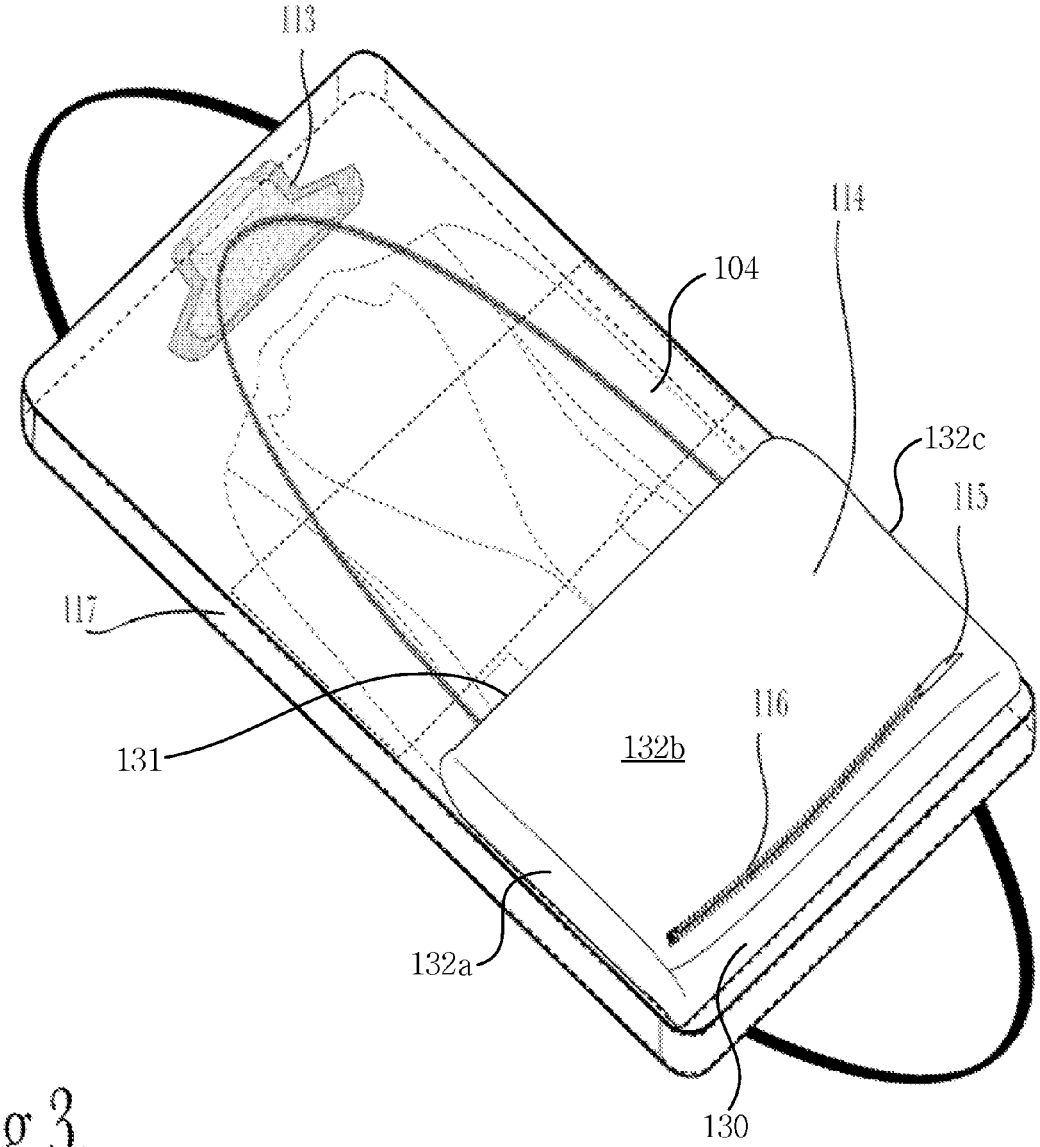
FIG. 3 is a perspective view of the garment carrier in the open position illustrating additional storage areas and extra features.

FIG. 3 illustrates an alternative embodiment in which a hanger-type securing apparatus (113) is installed as an additional mechanism for securing garments. The securing apparatus (113), is made of a rigid or semi-rigid material. A portion may be curved to retain and support the shoulder portion of garments such as shirts and dresses. A void or opening in the securing apparatus (113) may exist to accommodate pants-style garments. The securing apparatus may be attached or removably attached to one of the sheets (104, 105) within the main storage cavity (107) in a manner that allows the securing apparatus to hinge and allows for the installation of garments. The securing apparatus (113) should be installed in a location which will not subject the user to its rigid portions.

One or more internal bags (114) may be included for the storage of additional travel items. In some embodiments, the internal bags (114) can be substantially boxed-shaped and disposed in the area adjacent to the first sheet (104). For example, in the depicted embodiment the substantially boxed-shape internal bag (114) is defined by a top side (130), a bottom side (131), and four side sides (132*a*), (132*b*), (132*c*), and (132*d*). Side side (132*d*) is not visible in the depicted arrangement because it is adjacent to the first sheet (104). The internal bags (114) are accessible via plackets or other forms of pocket openings (115) and may include zippers, velcro or other types of reversible closures (116). The contents of the internal bags (114) may be accessed when the elongated pouch (100) is in the open, closing (partially open), or closed positions.

Also, shown are optional panels (117) which may be incorporated into the sides of the elongated pouch (100) to increase the volume and capacity within the main storage cavity (107). These optional panels (117) may be installed such what when not in use they reside compactly with elongated pouch (100).

Figure 4:
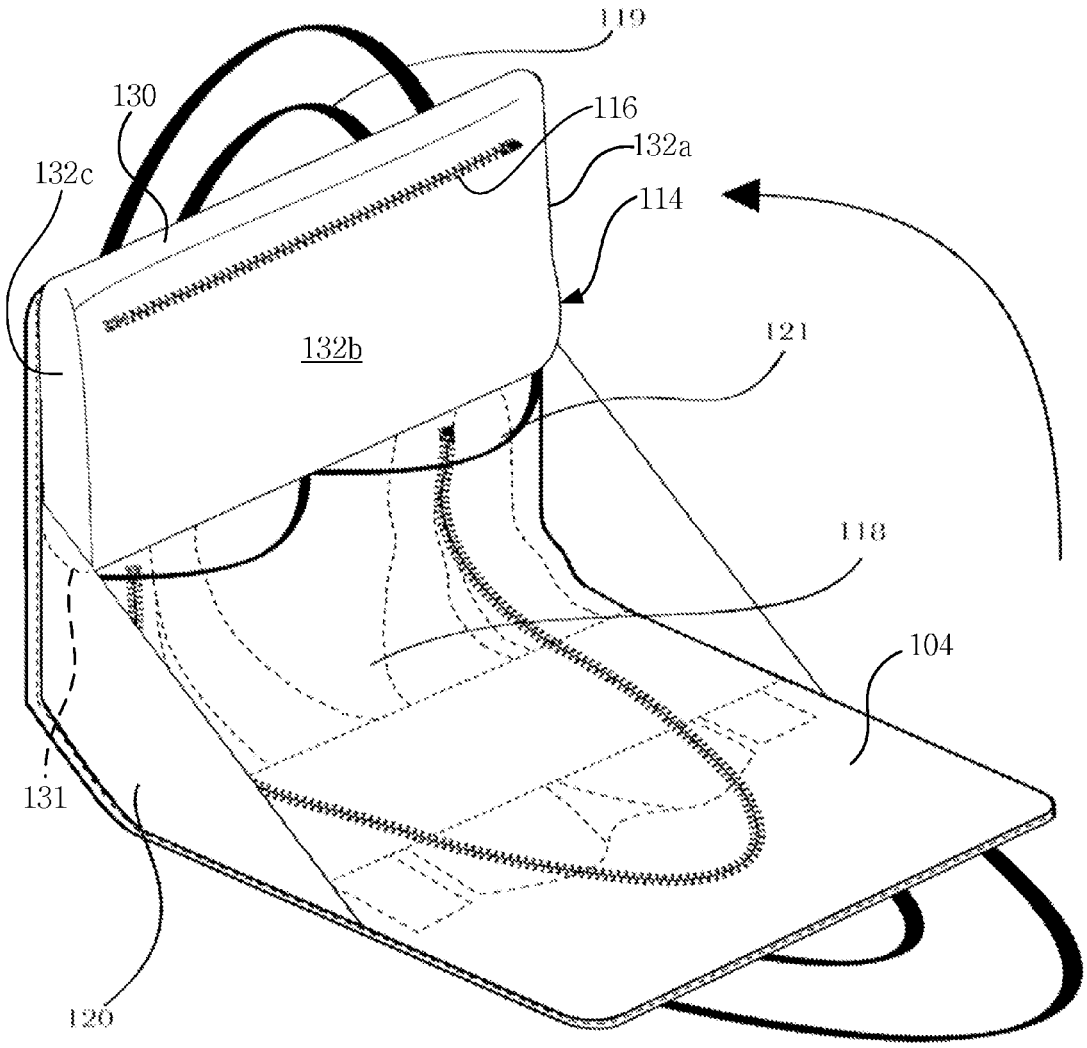
FIG. 4 is a perspective view of the garment carrier in the partially closed position.

FIG. 4 illustrates the invention in the closing position, this is the position that the invention passes through as it is transformed from the open position to the closed position and visa versa.

The area between the first sheet (104) becomes the secondary storage cavity (118) when the invention is in the closed or closing position.

A secondary set of carrying means to provide carrying options for the user, from here on referred to as the secondary carrying means (119).

The flexible sides (120) attached to the common peripheral edges to secure the garments. These panels are optional and serve as one means for providing security and closure to the invention.

Supplementary elastic straps or flexible pockets (121) are incorporated to secure or contain personal items such as shoes, swimsuits or hairdryers.

Figure 5:
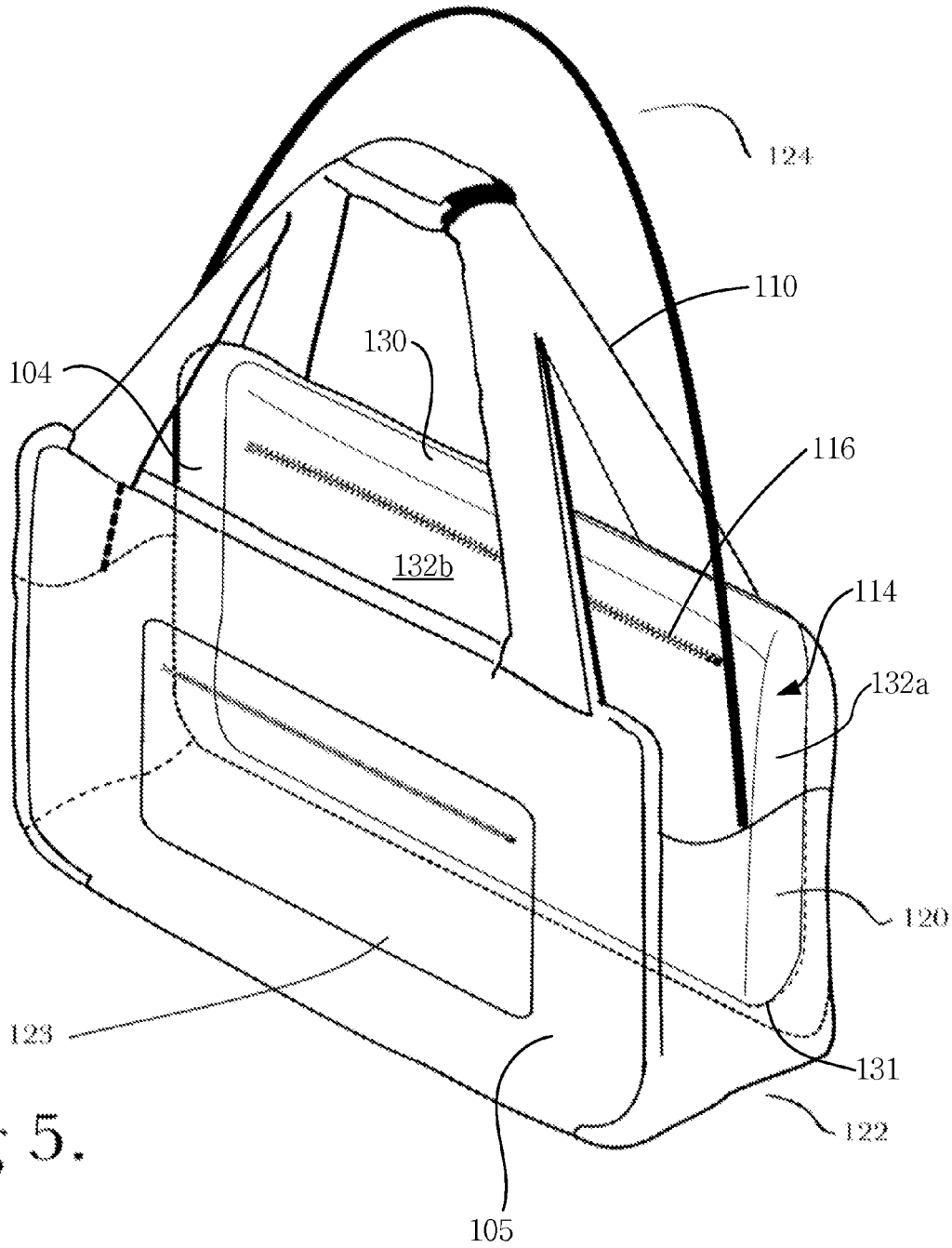
FIG. 5 is a perspective view of the garment carrier in the closed position.

FIG. 5 illustrates the base of support (122) which becomes manifest in the closed position. It is this base of support (122) which helps to provide wide curves to the garments while in this configuration rather than sharp, crease-causing folds because in some embodiments at least the first sheet (104) forms a generally radiused portion corresponding to the base of support (122). In the closed position, the bottom side (131) of the internal bags (114) is disposed adjacent to the generally radiused portion of the first sheet (104). This base of support (122) also reduces the overall length of the invention when in the closed position. This base of support (122) contributes to the self-supporting aspect of the invention. Also illustrated are the flexible sides (120) in their closed configurations. Also illustrated are external pockets (123) for additional storage, the carrying means (110), the reversible closure (116), and an example of an optional third carrying means (124).

Figure 6:
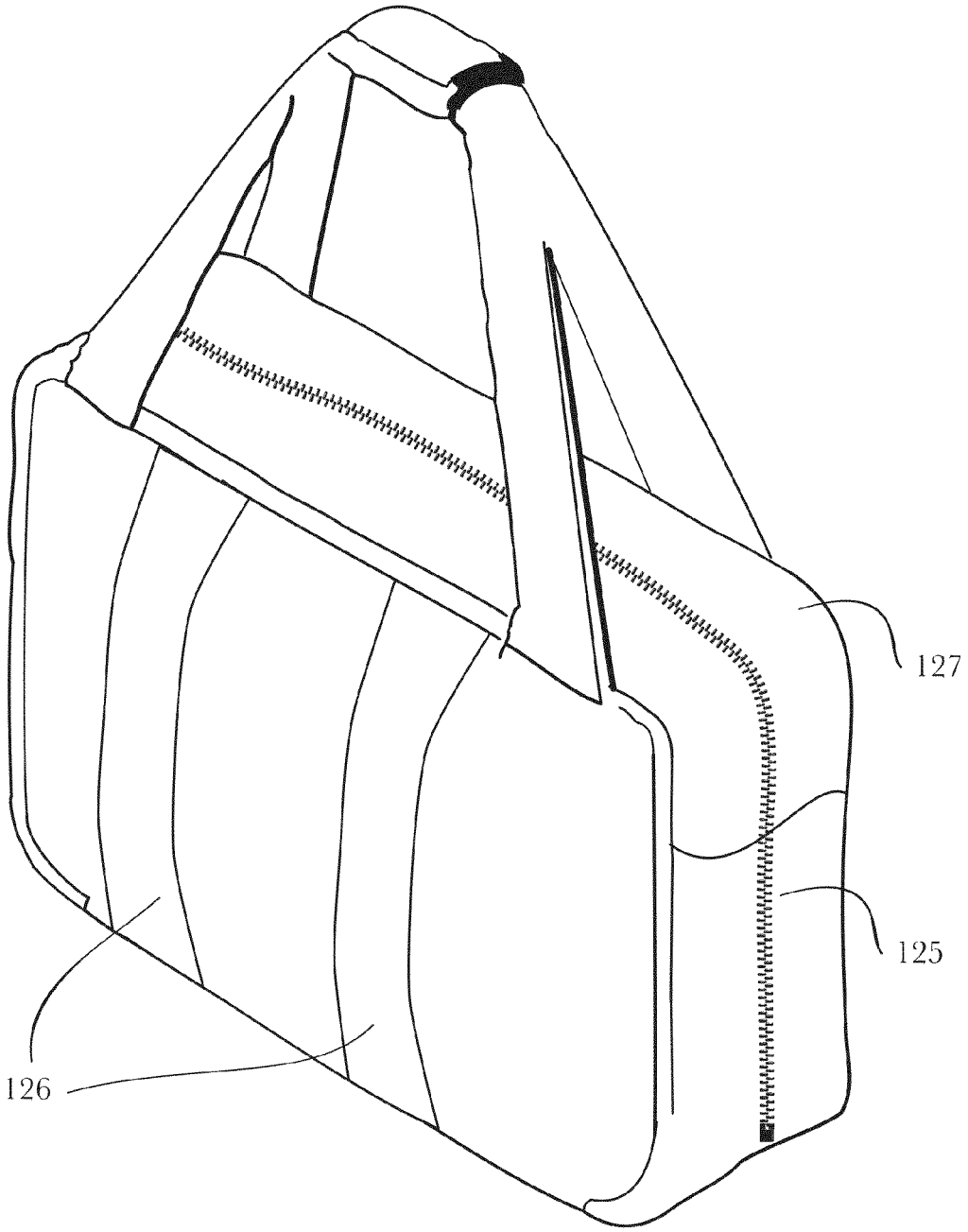
FIG. 6 is a perspective view on the garment carrier in the closed and reversibly sealed position.

FIG. 6 a perspective view on the elongated pouch apparatus in the closed and sealed position. The invention may be closed using a reversible closure (125) and may contain supplementary closing panels (127) for added security. Also illustrated are optional backpack-style straps (126).

It must also be understood that the detailed description which has preceded has only been given as an example and that it in no way limits the scope of the invention as defined in the appended claims.

CONCLUSIONS, RAMIFICATIONS, AND SCOPE

Accordingly, the reader will see that the ergonomic garment carrier of this invention can be used to pack and carry important garments easily and ergonomically. Additionally this invention addresses many of the modern travel complications while also providing a new option for many types of travelers who have not had their travel needs met. Specifically, this invention addresses the need to transport a garments of importance, along with other travel items in a carry-all piece of luggage. This is more important now given that people are traveling on shorter trips, but more frequently.

Although the description above contains many specificities, these should not be construed as limiting the scope of the invention but as merely providing illustrations of some of the presently preferred embodiments of this invention. For example, the garment carrier may be elliptical in shape; access to the main cavity may be through the seams or ends; the mechanism for retaining the carrier in the closed position may be elastic, etc.

Thus the scope of the invention should be determined by the appended claims and their legal equivalents, rather than by the examples given.

What is claimed:

1. A multi-configuration, ergonomic garment carrier comprising:

a substantially box-shaped internal bag portion comprising:

a top side, four side sides, and a bottom side that collectively define a storage pocket therebetween, and a reversible closure on at least one of the sides, for providing access to the storage pocket of the internal bag portion; and a substantially envelope-shaped, external garment bag portion comprising:

an internal side and an external side, wherein at least a portion of the peripheral edges of the internal side and the external side are affixed together, thereby defining a storage pocket therebetween, and wherein the internal bag portion is disposed adjacent to the internal side, and a reversible closure on the internal side, for providing access to the storage pocket of the garment bag portion, wherein, in a closed, transport configuration of the ergonomic garment carrier:

the internal side of the external garment bag portion encloses (i) the bottom side of the internal bag portion, (ii) at least a portion of at least two of the side sides of the internal bag portion, and (iii) the reversible closure on the internal side of the external garment bag portion, the internal side of the external garment bag portion includes a generally radiused portion, wherein the bottom side of the internal bag portion is disposed adjacent to the radiused portion, a portion of the external side of the external garment bag portion that is below the bottom side of the internal bag portion comprises a flexible panel that defines a base of support upon which the garment carrier is self-supported, and the reversible closure on the one side of the internal bag portion is accessible from above the garment carrier or from a side of the garment carrier, and wherein, in a partially open configuration of the ergonomic garment carrier:

the internal side of the external garment bag portion encloses at most (i) one of the side sides, and (ii) the bottom side of the internal bag portion, and the reversible closure on the internal side of the external garment bag portion, and the reversible closure on the one side of the internal bag portion, are accessible from above the garment carrier or from a side of the garment carrier.

2. The ergonomic garment carrier of claim 1, wherein the reversible closure on at least one of the sides of the internal bag portion is disposed on one of the four side sides of the internal bag portion, or on the top side of the internal bag portion.

3. The ergonomic garment carrier of claim 1, wherein the reversible closure on at least one of the sides of the internal bag portion is disposed on at least one of the four side sides of the internal bag portion, and on the top side of the internal bag portion.

4. The ergonomic garment carrier of claim 1, wherein the internal bag portion is permanently affixed to the internal side of the external garment bag portion or to the peripheral edge.

5. The ergonomic garment carrier of claim 1, wherein the common peripheral edges of the internal side of the garment bag portion and the external side of the garment bag are affixed together.

6. The ergonomic garment carrier of claim 1, wherein the at least the portion of the peripheral edges of the internal side of the garment bag portion and the external side of the garment bag portion are sewn, stitched, fused, or bonded together.

7. The ergonomic garment carrier of claim 1, wherein the external garment bag portion comprises:

exactly two handles, a respective one of which is affixed to each end of the external side of the garment bag portion, wherein, in the closed, transport configuration of the ergonomic garment carrier, the two handles of the external garment side of the garment bag portion are accessible from above the garment carrier or from the side of the garment carrier.

8. The ergonomic garment carrier of claim 1, wherein the external garment bag portion comprises:

a single handle, strap or yoke affixed to an external side of the external garment bag portion, wherein, in the closed, transport configuration of the ergonomic garment carrier, the single handle, strap or yoke is accessible from above the garment carrier or from the side of the garment carrier.

9. The ergonomic garment carrier of claim 1, wherein the reversible closures comprise zippers.

10. The ergonomic garment carrier of claim 1, wherein, in the closed, transport configuration, the portion of the internal side of the external garment bag portion encloses (i) the bottom side of the internal bag portion, and (ii) less than all of two side sides of the internal bag portion, and does not encloses any of the top side of the internal bag portion.

11. The ergonomic garment carrier of claim 1, wherein, in an open configuration, the internal side of the external garment bag portion encloses one side side of the internal bag portion, and does not enclose the bottom side of the internal bag portion.

12. The ergonomic garment carrier of claim 1, comprising:

a gusset disposed along at least a portion of the peripheral edges of the internal side and the external side.

13. The ergonomic garment carrier of claim 1, comprising:

one or more securing mechanisms disposed inside the storage pocket, for securing one or more garments that are placed inside the ergonomic garment carrier.

14. The ergonomic garment carrier of claim 1, wherein the external garment bag portion does not use a rigid portion to define the base of support.

15. The ergonomic garment carrier of claim 1, wherein the external garment bag portion does not use a supplemental panel to define the base of support.

* * * * *